US005266162A

United States Patent [19]

Richard et al.

[11] Patent Number: 5,266,162

[45] Date of Patent: Nov. 30, 1993

[54] PROCESS FOR COATING PAPERS AND ITS USE IN FLEXOGRAPHIC PRINTING

[75] Inventors: Michel Richard, L'Isle Adam; Claude Trouve, Yerres, both of France

[73] Assignee: Societe Francaise Hoechst, Puteaux, France

[21] Appl. No.: 16,539

[22] Filed: Feb. 11, 1993

Related U.S. Application Data

[62] Division of Ser. No. 806,188, Dec. 13, 1991, Pat. No. 5,229,168.

[30] Foreign Application Priority Data

Dec. 13, 1990 [FR] France ..... 90 15618

[51] Int. Cl.[5] ..... D21H 19/14

[52] U.S. Cl. ..... 162/135; 162/168.3; 427/391; 428/537.5

[58] Field of Search ..... 162/168.3, 135, 136; 427/391

[56] References Cited

U.S. PATENT DOCUMENTS

| | | | |
|---|---|---|---|
| 3,266,971 | 8/1966 | Miller | 427/391 |
| 4,077,930 | 3/1978 | Lim et al. | 162/168.3 |
| 4,294,873 | 10/1981 | Hartmann et al. | 427/391 |
| 4,450,203 | 5/1984 | Ragas et al. | 162/138 |
| 4,865,886 | 9/1989 | Itoh et al. | 427/391 |
| 5,098,520 | 3/1992 | Begala | 162/168.1 |
| 5,118,533 | 6/1992 | Saji et al. | 427/391 |
| 5,176,797 | 1/1993 | Hartan et al. | 162/168.3 |
| 5,219,619 | 6/1993 | Trouve et al. | 427/391 |

FOREIGN PATENT DOCUMENTS

| | | |
|---|---|---|
| 0162038 | 11/1985 | European Pat. Off. . |
| 325065 | 12/1987 | France . |

OTHER PUBLICATIONS

Abstract Bulletin of the Institute of Paper Chemistry, vol. 54, No. 2, Aug. 1983, Appleton US p. 226 Goto S. et al: "Emulsion for High Gloss Paper" *abstract*.

*Primary Examiner*—Shrive Beck
*Assistant Examiner*—Erma Cameron
*Attorney, Agent, or Firm*—Browdy and Neimark

[57] ABSTRACT

Process for coating papers and other articles in which the said papers and other articles are treated at pH 4 to 5 with a cross-linked anionic polymer, insoluble in water, and use for obtaining papers or other similar articles intended to be flexographically printed.

10 Claims, No Drawings

PROCESS FOR COATING PAPERS AND ITS USE IN FLEXOGRAPHIC PRINTING

This is a division of application Ser. No. 07/806,188, filed Dec. 13, 1991, now U.S. Pat. No. 5,229,168.

FIELD OF INVENTION

Background of the Invention

The present invention relates to a process for coating papers and its use in flexographic printing.

Flexographic printing is a letterpress technique using flexible plates, commonly used today for printing various paper-based carriers such as bags or packing cases, wallpaper intended for covering walls, serviettes and tablecloths, envelopes, etc . . . Flexographic printing can be mono- or polychrome and it preferably uses water-based inks in order to eliminate the pollution produced by the organic solvents of traditional inks. The use of water-based inks is often incompatible with high productivity and good quality printing because on traditional paper carriers, these water-based inks have a tendency to bleed, run, and smudge and furthermore, they take a long time to dry. Therefore a coating process is sought which would provide paper capable of being flexographically printed with water-based inks without causing bleeding and/or running, whilst providing a high productivity. In order to do this, either the use of special inks, or modification of the state of the paper surface have been proposed. Amongst these modifications, there can be mentioned notably treatment with wetting agents, the use of special adjuvants such as hydrosoluble polymers, special refining of the printer's pie, use of special fillers, etc . . .

These various modifications do not however permit good quality flexographic printing with high productivity and a low cost. In order to respond to the more and more drastic demands of the market, the Applicant has discovered a new coating process for papers intended to be flexographically printed allowing high printing rates, at a low cost without causing smudging, running and/or penetration.

SUMMARY OF THE INVENTION

The process according to the present invention is characterized in that the papers, boxes and other similar articles are treated with a cross-linked anionic polymer insoluble in water, generally of high molecular weight. By high molecular weight is meant higher than 1 million. This cross-linked anionic copolymer is either a homopolymer of acrylic acid partially or totally salified with an alkali metal or with ammonia, or a copolymer of acrylamide and acrylic acid partially or totally salified with an alkali metal or ammonia. Advantageously, the salification rate of the acrylic acid is greater than or equal to 60%. The copolymers preferably contain, in molar proportions, 1 to 20% of acrylamide. Cross-linking is achieved notably with a standard diethylene cross-linking agent possessing acrylamide groups such as methylene bisacrylamide, bisacrylamidoacetic acid and preferably cross-linking is carried out with bisacrylamidoacetic acid. The doses of cross-linking agent relative to the total weight of the monomers vary from 10 to 1000 ppm, advantageously this dose is comprised between 50 and 500 ppm and preferably 100 ppm. The cross-linked anionic polymer insoluble in water which can be used according to the invention is a polymer of high molecular weight; for its implementation according to present process, it is advantageously dispersed in the aqueous phase of an self-reversible water-in-oil emulsion, notably in the form of small-sized particles of less than 10 μm. These self-reversible water-in-oil emulsions are constituted on the one hand by a continuous oil phase based on paraffin or naphthene-paraffin oil, liquid at ambient temperature, and having a boiling point of 100° to 350° C., and on the other hand by an aqueous phase.

DESCRIPTION OF THE PREFERRED EMBODIMENT

Usable oils can be obtained from various suppliers such as the SHELL company.

These emulsions contain 65 to 75% by weight of a dispersed aqueous phase of which 35 to 50% is an anionic hydrophilic copolymer of molecular weight greater than $10^6$, 2 to 7% by weight of a mixture of emulsifiers of which at least one is soluble in the aqueous phase, and the complement to 100% by weight of an oil phase.

Among the usable emulsifiers, there can be mentioned notably sorbitan monooleate and ethoxylated nonylphenols with 8 to 12 molecules of ethylene oxide.

This type of emulsion is described in the literature and for the implementation of the process according to the invention, known thickeners for pigment printing based on acrylic acid polymer partially or totally salified by ammonia presented as an self-reversible water-in-oil emulsion such as those described in the European Patent Application No. 325,065 are particularly suitable.

The process according to the invention is implemented at a pH comprised between 4 and 5, advantageously at a pH of about 4. A pH of less than 4 is not desirable due to the corrosion that it causes on the materials and a pH greater than 5 leads to coating colours of high viscosity which are difficult to handle.

The process according to the invention can be carried out according to standard paper coating methods by depositing on the paper to be treated 1 to 30 g per square meter of cross-linked anionic polymer. The deposit is for example carried out in an aqueous medium, at a pH comprised between 4 and 5, on a traditional coating machine.

In order to appreciate the performances of papers treated by the process according to the invention, a comparison has been made between the characteristics of papers treated by the process according to the present invention and those of papers treated by known processes, using either oxidized starch, or a carboxymethylcellulose, or a polyvinyl alcohol. Tables I and II show the results obtained. The paper used for the tests is a kraft packing paper of 70 g/m$^2$. The deposits are carried out with a wound-wire rod on 5 sheets. After deposition, the papers are dried at 105° C. for 5 minutes, then the creases are removed by light calendering. The weight of the deposits is determined by weighing. Printing is carried out with a red ink for flexographic printing (ink type SL 2742, red 3 from the MARCOLAC SIEM Company), diluted with water until an efflux time of 21±1 seconds is obtained, according to the Ford cup method No. 4. Printing is carried out at a constant speed of 0.8 m/s on an IGT AI-C25 apparatus, at a pressure of 500 N and with an aluminium upper roller. A drop of ink is deposited on the aluminium roller, printing is then started and the drop is spread out over the surface of the paper. In this way printing is obtained over a certain length which is proportional to the absorption capacity of the paper.

TABLE 1

| No | WATER | pH | Sox | CMC | E | PVA | Total Weight |
|---|---|---|---|---|---|---|---|
| 1 | 486.275 | 7 | 13.725 | | | | 550 |
| 2 | 472.55 | 7 | 27.45 | | | | 550 |
| 3 | 445.10 | 7 | 54.9 | | | | 550 |
| 4 | 390.20 | 7 | 109.8 | | | | 550 |
| 5 | 590.64 | 7 | | 9.36 | | | 600 |
| 6 | 581.28 | 7 | | 18.72 | | | 600 |
| 7 | 562.56 | 7 | | 37.44 | | | 600 |
| 8 | 537.60 | 7 | | 62.4 | | | 600 |
| 9 | 425 | 4 | | | 25 | | 450 |
| 10 | 400 | 4 | | | 50 | | 450 |
| 11 | 350 | 4 | | | 100 | | 450 |
| 12 | 400 | 4 | | | 55 | | 455 |
| 13 | 400 | 7 | | | 55 | | 455 |
| 14 | | 7 | | | | 400 | 400 |

TABLE II

| Formulae | Ink Transfer print length | Ink Transfer optical density | Ink Transfer brightness | Offsetting optical density carrier | Offsetting optical density offsetting | Resistance to water | Penetration | Brookfield viscosity mPa.s | Deposit g/m² |
|---|---|---|---|---|---|---|---|---|---|
| 1 | 10.4 | 1.18 | 21.6 | 1.08 | 0.60 | 1 | 5 | 16 | 0.94 |
| 2 | 12.1 | 1.16 | 25.1 | 0.91 | 0.64 | 2 | 4 | 20.5 | 2 |
| 3 | 13.5 | 1.17 | 30.9 | 0.92 | 0.64 | 5 | 1 | 38 | 4.2 |
| 4 | 13.5 | 1.29 | 37.5 | 0.95 | 0.66 | 5 | 1 | 490 | 9.7 |
| 5 | >14 | 1.05 | 27.3 | 0.89 | 0.62 | 2 | 3 | 34 | 0.65 |
| 6 | >14 | 1.09 | 30.0 | 0.85 | 0.63 | 4 | 2 | 98 | 0.65 |
| 7 | >14 | 1.22 | 27.4 | 0.93 | 0.65 | 5 | 1 | 455 | 2.5 |
| 8 | 12.7 | 1.34 | 35.4 | 1.11 | 0.62 | 5 | 2 | 6650 | 4.4 |
| 9 | 13.3 | 1.12 | 25.3 | 0.98 | 0.59 | 2 | 4 | 145 | 0.9 |
| 10 | 13.9 | 1.14 | 25.8 | 1.03 | 0.57 | 3 | 4 | 170 | 1.97 |
| 11 | 12.2 | 1.23 | 19.6 | 1.13 | 0.55 | 3 | 3 | 2100 | 430 |
| 12 | 13.0 | 1.17 | 26.5 | 1.06 | 0.59 | 3 | 4 | 930 | 2.18 |
| 13 | 11.4 | 1.17 | 22.0 | 1.05 | 0.52 | 3 | 4 | 8800 | 2.00 |
| 14 | >14 | 1.10 | 43.4 | 0.77 | 0.67 | 4 | 2 | 70 | 3.3 |
| T | 8.4 | 1.27 | 20.3 | 1.15 | 0.69 | 1 | 5 | 0 | 0 |

Table I shows the formulae of the baths used for coating the paper before printing. In this table, the oxidized starch, designated Sox, comes from the Société des Produits du Maïs, SPDM, and is marketed under the reference AMISOL® 5591, the carboxymethylcellulose, designated CMC, is marketed by the Applicant under the reference TYLOSE® VCLL, the polyvinyl alcohol, designated PVA, is marketed by the Applicant under the reference MOWIOL® 98-4 and the thickener used, designated E, is an oil-in-water emulsion containing 29.3% by weight of an acrylamide (AAM) - acrylic acid (AA) - ammonium acrylate ($AANH_4$) copolymer, 20.5-26-53 in molar proportions, cross-linked with 100 ppm of bisacrylamidoacetic acid (BAAA) relative to the weight of the copolymer, 42.6% by weight of water, 23.4% by weight of $C_{10}$–$C_{13}$ paraffin oil and 4.7% by weight of a mixture of emulsifiers 46.4% of which is constituted by sorbitan sesquioleate and the complement to 100% by two emulsifiers soluble in water having an HLB Hydrophile Lipophile Balance value greater than 8. In table I all the quantities are expressed in grams. The adjustment of the pH of certain formulae to pH=4 is carried out by the addition of hydrochloric acid.

Starting with the bath formulae given in table I, different deposits of 1 to 10 g/m² were carried out.

The results of 10 successive trials with each formula for different deposits are assessed in the tests for printing density, offsetting, penetration and resistance to water. By way of comparison, a non-treated paper carrier was also tested; the results obtained are given under the reference T. The averages of the values obtained in the 10 trials carried out in each test are shown in table II. In this table, the printing length is expressed in centimeters, the resistance to water and penetration are marked from 1 to 5, value 1 corresponds to a good resistance to water or to a slight penetration, and value 5 corresponds to a bad resistance to water or a significant penetration. The Brookfield viscosities are expressed in mPa.s and they are determined with an RVT model Brookfield apparatus at 20° C., the cylinder and its rotational speed being chosen from the recommended ranges.

The ink transfer and offsetting are determined according to known techniques by measuring the optical printing density of the carrier and the set-off paper. The printing density is measured using a MACBETH RD 100 reflection densitometer, the reflection factor p is defined as the ratio Ir/Ii where Ir represents the intensity of the reflected light and Ii the intensity of the incident light, the optical density, o.d., is the decimal logarithm of the inverse of the reflection factor and given by the formula:

$$\text{o.d.} = \log \frac{1}{p} = \log \frac{Ii}{Ir}$$

The printing brightness is assessed with a GARDNER reflectometer working at 75° and it is expressed as a refection percentage. Before being tested, the samples are dried for 5 minutes in an oven at 105° C.

The resistance to water is measured by plunging printed sheets of 55 by 300 mm in a 1-liter beaker filled with water, for 45 minutes at 20° C., 4 times in succession and then evaluating the amount of ink remaining on the carrier by measuring the optical density. Penetration is assessed by examining the reverse side of the printed sheet by the same method.

The printing length enables the amount of ink absorbed naturally by the carrier in a given time to be evaluated. In order to do this, a drop of ink is spread between two rollers: the length of the ink trail obtained is larger the less ink is absorbed by the carrier.

In table III the results obtained with a deposit of 4 g/m² of Sox. starch, CMC and E are given.

TABLE III

| | Ink transfer | | Offsetting | | | |
|---|---|---|---|---|---|---|
| | length | o.d. | o.d. carrier | o.d. set-off paper | Penetration | Resistance to water |
| T | 8.4 | 1.27 | 1.15 | 0.69 | 5 | 1 |
| Sox | 13.5 | 1.17 | 0.92 | 0.64 | 1 | 5 |
| CMC | 12.7 | 1.34 | 1.11 | 0.64 | 2 | 5 |
| E | 12.2 | 1.23 | 1.13 | 0.55 | 3 | 3 |

With the non-treated carrier T, the ink is absorbed easily (small printing length: 8.4 cm) and it penetrates deeply giving significant penetration. Furthermore, although the printing surface is small, the printing density is not very high, a proportion of the ink is lost in the carrier. Also the printing density of the set-off paper applied straight-away to the printed carrier remains high: the ink is absorbed quickly but is badly fixed. Only the resistance to water is good because the ink has penetrated deeply into the carrier. Product E enables the defects mentioned above to be reduced: it enables the smallest offsetting for a good printing density to be obtained; the ink is fixed quickly and well, while having the correct resistance to water and the correct penetration. Visual examination enables it to be observed that with product E, the ink is fixed on the surface, gives a remarkable cover and a soft and smooth touch and finally, on colored carriers, it leads to a clearer printing.

The result of all these trials is that the formulae based on emulsion E containing a cross-linked anionic polymer give the treated carrier very good properties: reduced offsetting, good printing density, good printing yield. Furthermore, the process according to the invention enables a smooth and soft carrier to be obtained, which is very suitable for making various articles.

This is why a final subject of the present invention is the use of the process described above for obtaining papers or other similar articles intended to be flexographically printed.

What is claimed is:

1. A paper-based flexographic carrier sheet, suitable for flexographic printing, said carrier sheet being coated only over substantially an entire surface thereof with a water insoluble cross-linked anionic polymer in an amount sufficient to provide a flexographic ink-receiving layer thereon, wherein said anionic polymer is a homopolymer of acrylic acid partially or totally salifie by an alkali metal or ammonia, or a copolymer of acrylamide and acrylic acid partially or totally salified by an alkaline metal or ammonia.

2. A carrier sheet according to claim 1 wherein said anionic polymer is cross-linked with 10 to 1,000 ppm, based on the weight of monomer, or bisacrylamidoacetic acid or methylenebisacrylamide.

3. A carrier according to claim 1 wherein said anionic polymer is salified to at least 60%.

4. A carrier sheet according to claim 1 wherein said layer has a coating weight of 1–30 g/m$^2$.

5. A carrier sheet according to claim 1 wherein said anionic polymer has a molecular weight greater than $10^6$.

6. A flexographically printed paper or carrier sheet produced by the method of pre-treating a paper or paper based carrier by coating substantially only an entire surface of said paper or paper based carrier with a water insoluble cross-linked anionic polymer at a pH of 4 to 5 to provide a coating thereon permitting improved flexographic printing with water-based flexographic inks without smudging, running or penetration; and then flexographically printing said coated paper.

7. A printed paper or carrier sheet according to claim 6 wherein said anionic polymer is cross-linked with 10 to 1,000 ppm, based on the weight of monomer, of bisacrylamidoacetic acid or methylenebisacrylamide.

8. A flexographically printed paper or carrier sheet according to claim 6 wherein said coating has a coating weight of 1–30 g/m$^2$.

9. A flexographically printed paper or carrier sheet according to claim 6 wherein said anionic polymer has a molecular weight greater than $10^6$.

10. A flexographically printed paper sheet comprising a base layer of paper, a surface coating layer covering substantially an entire surface of said paper sheet, and a flexographic ink printed on said surface coating layer, said surface coating layer comprising 1–30 g/m$^2$ of a water insoluble cross-linked anionic polymer which is a homopolymer of acrylic acid partially or totally salified by an alkaline metal or ammonia, or a copolymer of acrylamide and acrylic acid partially or totally salified by an alkali metal or ammonia.

* * * * *